US010381213B2

(12) United States Patent
Guna

(10) Patent No.: US 10,381,213 B2
(45) Date of Patent: Aug. 13, 2019

(54) MASS-SELECTIVE AXIAL EJECTION LINEAR ION TRAP

(71) Applicant: DH Technologies Development Pte. Ltd., Singapore (SG)

(72) Inventor: Mircea Guna, North York (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/763,878

(22) PCT Filed: Sep. 23, 2016

(86) PCT No.: PCT/IB2016/055704

§ 371 (c)(1),
(2) Date: Mar. 28, 2018

(87) PCT Pub. No.: WO2017/055978

PCT Pub. Date: Apr. 6, 2017

(65) Prior Publication Data

US 2018/0286659 A1 Oct. 4, 2018

Related U.S. Application Data

(60) Provisional application No. 62/235,818, filed on Oct. 1, 2015.

(51) Int. Cl.
*H01J 49/42* (2006.01)
*H01J 49/06* (2006.01)

(52) U.S. Cl.
CPC ..... *H01J 49/4225* (2013.01); *H01J 49/063* (2013.01); *H01J 49/4215* (2013.01)

(58) Field of Classification Search
CPC ... H01J 49/4225; H01J 49/063; H01J 49/4215
See application file for complete search history.

(56) References Cited

U.S. PATENT DOCUMENTS

| | | | | |
|---|---|---|---|---|
| 3,371,204 | A * | 2/1968 | Brubaker | H01J 49/4215 250/292 |
| 6,177,668 | B1 | 1/2001 | Hager | |
| 7,453,061 | B2 * | 11/2008 | Park | H01J 49/4215 250/292 |
| 8,212,208 | B2 * | 7/2012 | Green | H01J 49/4285 250/283 |
| 9,123,516 | B2 * | 9/2015 | Hasegawa | H01J 49/063 |
| 2005/0006580 | A1 | 1/2005 | Hager | |

(Continued)

OTHER PUBLICATIONS

International Search Report and Written Opinion for PCT/IB2016/055704 dated Jan. 4, 2017.

(Continued)

*Primary Examiner* — Wyatt A Stoffa

(57) ABSTRACT

A linear ion trap includes a quadrupole having four substantially parallel conductive rods that are substantially coextensive in the axial direction. The rods include two diagonally arranged pairs including one continuous, rod pair and one pair of rods that are segmented such that the two segments in a rod are capacitively coupled to facilitate an RF drop when an RF signal is applied to one longer segment and capacitively provided to the other shorter segment. An RF signal is provided to the continuous rods and tire longer segment of the segmented rods.

20 Claims, 10 Drawing Sheets

(56) References Cited

U.S. PATENT DOCUMENTS

| | | | | |
|---|---|---|---|---|
| 2005/0242281 | A1* | 11/2005 | Li | H01J 49/4225 250/292 |
| 2007/0057180 | A1* | 3/2007 | Hansen | H01J 49/4225 250/292 |
| 2007/0138389 | A1* | 6/2007 | Park | H01J 49/4215 250/290 |
| 2009/0194688 | A1 | 8/2009 | Bateman et al. | |
| 2009/0294663 | A1 | 12/2009 | Muntean et al. | |
| 2011/0049358 | A1* | 3/2011 | Green | H01J 49/4225 250/283 |
| 2012/0256082 | A1* | 10/2012 | Masujima | H01J 49/4225 250/282 |
| 2013/0240726 | A1* | 9/2013 | Hasegawa | H01J 49/063 250/288 |
| 2015/0097115 | A1* | 4/2015 | Schwartz | H01J 49/4215 250/283 |
| 2015/0255264 | A1* | 9/2015 | Baba | H01J 9/427 250/283 |
| 2018/0174817 | A1* | 6/2018 | Green | H01J 49/4215 |

OTHER PUBLICATIONS

Hager, J.W., A New Linear Ion Trap Mass Spectrometer; Rapid Commun. Mass Spectrom, 2002; 16:512-526.

Londry, F.A.; Hager, J.W., Mass Selective Axial Ion Ejection from a Linear Quadrupole Ion Trap, J. Am. Soc. Mass. Spectrom. 2003, 14:1130-1147.

Raizen et al, Ionic Crystals in a Linear Paul Trap; Rhys. Rev. A, vol. 45, No. 9, 6493-6501, May 1992.

* cited by examiner

20kDa/s

10kDa/s

MASS-SELECTIVE AXIAL EJECTION LINEAR ION TRAP

This application claims priority to U.S. provisional application No. 62/235,818 filed on Oct. 1, 2015, entitled "Mass Selective Axial Election Linear Ion Trap," which is incorporated herein by reference in its entirety.

BACKGROUND

Ion trap mass spectrometers typically allow son scanning by essentially filling an ion trap in a mass-independent manner and emptying the trap in a mass-dependent manner by manipulating the RF and DC voltages applied to one or more of the electrodes. The ion storage and fast scanning capabilities of the ion trap are advantageous in analytical mass spectrometry. High analysis efficiency, compared to typical beam-type mass spectrometers, can be achieved if the time to eject and detect ions from the trap is smaller than the time required to fill a trap. If this condition is met, then very few ions are wasted.

Linear quadrupoles have been widely used in some mass spectrometers for many years. Generally, these devices are constructed from four parallel rods within which a two-dimensional quadrupole field is established (in the x-y plane). Mass selection is achieved by appropriately choosing a combination of radiofrequency (RF) and direct-current (DC) voltages, such that ions within a very narrow mass-to-charge window are stable over the length of the quadrupole.

Conventional ion trap mass spectrometers, on the other hand, operate with a three-dimensional quadrupole field. These instruments are capable of very high efficiencies, since the time to fill the ion trap and generate a complete mass spectrum can be very short. A problem with 3-D ion traps is that they generally have poor trapping efficiencies, such as less than 10%, for externally generated ions. This is primarily due to their small volume. This small volume also results in a limited dynamic range, since there is a maximum charge density beyond which the response of the top becomes nonlinear with respect to ion number, and the quality of the mass spectra deteriorates.

The advantages associated with the trapping of ions in linear traps can include the following. Linear ion traps have a very high acceptance, since there is generally no quadrupole field along the z-axis (axial/parallel to the rods). Ions admitted into a pressurized linear quadrupole undergo a series of momentum dissipating collisions with a carrier gas in a collision cell, effectively reducing axial energy prior to encountering the end electrodes, thereby enhancing trapping efficiency. That is, the reduced momentum avoids requiring a large DC barrier to contain ions in the axial direction. Larger volume of the pressurized linear ion trap relative to the 3-D device also means that more ions can be stored prior to the onset of any deleterious effects of space charge. Finally, radial containment of ions within a linear ion trap results in strong focusing along the centerline of the trap, in contrast to the 3-D trap in which fields tend to focus the trapped ions to a point. Line rather than point focusing properties may have tin influence on the relative susceptibilities to space charge phenomena.

Ions can be trapped within a linear ion trap and mass selectively ejected in a dimension perpendicular to the center axis of the trap, via radial excitation techniques. Exemplary devices for radial ejection trap ions in the radial dimension by an RF quadrupole field, and by static DC potentials at the ends of the rod structure. Many of the scan functions commonly used in conventional 3-D ion traps can also be applied to these linear 2-D ion traps. Upon ejection, ions emerge radially over the length of the quadrupole rod structure and can be detected using conventional means. Radial mass-selective ion ejection occurs when the RF voltage is ramped in the presence of a sufficiently intense auxiliary AC voltage. The auxiliary AC resonance-ejection voltage is applied radially and the ions emerge from the linear ion trap through slots cut in the quadrupole rods. Radial ejection requires that the RF field be of high quality over the entire length of the ion trap in order to preserve mass spectral resolution, since resolution depends on the fidelity of the secular frequency of the trapped ions. Thus, very high mechanical precision is required in fabrication of the quadrupole rods in order to maintain the same secular frequency over the length of the device.

There are several disadvantages of radial ejection of ions from a two-dimensional RF quadrupole. One disadvantage is that radial ejection expels ions through or between the quadrupole (or higher order multipole) rods. This forces the ions through regions of space for which these are significant RF field imperfections. The effect of these imperfections is to eject ions at points not predicted by the normal stability diagram. Radial ejection from a two-dimensional RF quadrupole has the further disadvantage of providing a poor match between the dimensions of the plug of ejected ions and conventional ion detectors. In a linear or curved rod structure, radially ejected ions will exit throughout the length of the device, i.e. with a rectangular cross-section of length corresponding to the rods themselves. Most conventional ion detectors have relatively small circular acceptance apertures (e.g. less than 2 $cm^2$) that are not well-suited for elongated ion sources. Mass selective instability for radial ion ejection of ions from a two-dimensional RF quadrupole has additional problems. Ions ejected radially from such a device will exit with a diverging spacial profile with a characteristic solid angle. Same of the ejected ions will hit the rods and be lost. In addition, radially ejected ions will leave the trapping structure in opposite directions. Multiple ion detectors would be required to collect all the ions made unstable by similar techniques. Ions ejected away from the detector(s) or which encounter one of the electrodes are lost and therefore do not contribute to the measured ion signal. Therefore, only a small fraction of trapped ions would normally be collected, despite the very high storage ability of this device.

Mass-selective axial ejection (MSAE) of ions from linear quadrupole ion traps allows ions to be ejected axially, which can be a better special match for detectors. Most MSAE systems take advantage of RF fringing fields at the axial end of a quadrupole to convert radial ion excitation into axial ion ejection in a manner analogous to resolving RF-only mass spectrometers.

Trapped ions are given some degree of radial excitation via a resonance excitation process, and in the exit fringing-field, this radial excitation results in additional axial ion kinetic energy that can overcome an exit DC barrier. MSAE of ions from a linear quadrupole ion trap has been shown to add high-sensitivity and high-resolution capabilities to traditional triple quad mass spectrometers. Trapped, thermalized ions can be ejected axially in a mass-selective way by ramping the amplitude of the RF drive, to bring ions of increasingly higher m/z (mass to charge ratio) into resonance with a single-frequency dipolar auxiliary signal, applied between two opposing rods. In response to the auxiliary signal, ions gain radial amplitude until they are ejected axially or neutralized on the rods. In general, the radial excitation voltage is lower than that used to perform mass-selective radial ejection since the goal is provide a degree of radial excitation rather than radial ejection.

Several techniques have been proposed in the prior art for effecting axial ejection of ions from a linear ion trap. Exemplary systems for MSAE utilizing fringing fields is described in Hager, J. W., A New Linear Ion Trap Mass Spectrometer; Rapid Commun. Mass Spectrum, 2002; 16:512-526, and U.S. Pat. No. 6,177,688. The electric field responsible for MSAE of ions trapped in a linear quadrupole ion trap have been studied and characterized in the prior art. For example, such electric fields are discussed in detail in Londry, F. A.; Hager, J. W., Mass Selective Axial Ion Ejection from a Linear Quadrupole Ion Trap, J. Am. Soc. Mass. Spectrom. 2003, 14:1130-1147. In a conventional quadrupole ion trap utilizing MSAE, axial ejection occurs as a consequence of the trapped ions' radial motion, which is characterized by extrema that are phase-synchronous with the local RF potential. As a result, the net axial electric field experienced by ions in the fringe region, over one RF cycle, is positive. This axial field depends strongly on both the axial and radial ion coordinates. The superposition of a repulsive potential applied to an exit lens with the diminishing quadrupole potential in the fringing region near the end of a quadrupole rod array can give rise to an approximately conical surface on which the net axial force experienced by an ion, averaged over one RF cycle, is zero. This conical surface can be referred to as the cone of reflection because it divides the regions of ion reflection and ion ejection. Once, an ion penetrates this surface, it feels a strong net positive axial force and is accelerated toward the exit lens. As a consequence of the strong dependence of the axial field on radial displacement, trapped thermalized ions can be ejected axially from a linear ion trap in a mass-selective way when their radial amplitude is increased through a resonant response to an auxiliary signal.

The above mentioned MSAE ion trap systems are used in the ion path of a linear mass spectrometer. While this ion path may include a plurality of quadrupole sections, in general only the last quadrupole section is utilized as an ion trap, with initial quadrupole stages assisting in collimating the ion path in the axial direction. Ion injection is accomplished, in these examples, utilizing the fringing fields that occur at the radial and of the parallel rods that form the quadrupole of the ion trap. The quadrupole rods in the ion trap are substantially equal in length and parallel.

SUMMARY

Various embodiments address or overcome some of the problems of the prior art by providing a quadrupole having four rods that are substantially coextensive in the axial direction, where two of the rods (diagonally opposed) are segmented such that the two segments in a rod are capacitively coupled to facilitate an RF drop when an RF signal is applied to one segment and capacitively provided to the other segment.

According to various aspects of the present teachings, a linear ion trap configured for mass selective axial ejection includes a pair of parallel continuous conductive rods and a pair of parallel segmented conductive rods having a long segment and a shorter segment disposed at an exit end of the linear ion trap. The two pairs of conductive rods are axially aligned to be substantially parallel with one another and substantially coextensive in the axial direction. For example, the pairs of rods can overlap 90% or more in the axial direction and are parallel to at least within two degrees. The rod pairs are also interleaved with one another such that each conductive rod in a pair is diagonal to the other conductive rod in that pair. The linear ion trap farther includes an RF signal generating source configured to supply an RF signal having a first voltage and a first frequency to each rod in the pair of parallel continuous conductive rods and the long segment of each rod in the pair of parallel segmented conductive rods. A pair of capacitors electrically couples the RF signal from the long segments to the shorter segments such that a voltage of the RF signal applied to the shorter segment is reduced by at least 1% relative to the first voltage of the RF signal (e.g., 15-25% less than the first signal).

In various aspects, the RF signal applied to the rods can comprise a first signal having a first phase provided to the pair of parallel continuous conductive rods and a second signal having a second opposite phase provided to the long segment of each rod in the pair of parallel segmented conductive rods. In some aspects, for example, the RF signal generating source can be configured to apply an auxiliary AC signal, at a lower voltage and frequency than the RF signal, to the pair of parallel continuous conductive rods during an axial ejection procedure. For example, the auxiliary RF signal comprises an auxiliary frequency having a predetermined value related to the first frequency of the RF signal.

In some aspects, the linear ion trap can further comprise a DC voltage source configured to provide a first DC voltage to the long segment of each rod in the pair of parallel segmented conductive rods and a second higher DC voltage to the shorter segment of each rod in the pair of parallel segmented conductive rods.

In accordance with various aspects of the present teachings, a mass spectrometer using mass selective axial ejection is provided, the mass spectrometer comprising an ion source configured to supply ions in an axial direction and located at one end of the axis; an ion detector located at the other end of the axis; a linear ion trap comprising two overlapping parallel pairs of conductive rods of substantially the same length located between the ion source and the ion detector along the axis of the ion trap, the two overlapping parallel pairs comprising a first pair of continuous rods and a second pair of segmented rods. The segmented rods each have a long segment and a shorter segment that is located closer to the ion detector end of the ion trap axis relative to the long segment, wherein each rod in the two pairs is located diagonally from the other rod in that pair, such that each rod in a pair is adjacent to the rods of the other pair. The mass spectrometer can also include an RF signal generating source configured to supply an RF signal, having a first voltage and a first frequency, to each rod in first pair of continuous rods and to the long segments of the segmented rods of the second pair. A pair of capacitors electrically couples the RF signal from the long segments to the shorter segments of each of the segmented rods of the second pair such that a second voltage is applied to the shorter segments reduced by at least 1% (e.g., 15-25%) relative to the first voltage of the RF signal. In various aspects, the RF signal applied to the rods comprises a first signal having a first phase coupled to the first pair of continuous rods and a second signal having a second opposite phase coupled to the second pair of segmented rods. In some aspects, the RF signal generating source can be configured to provide an auxiliary AC signal, at a lower voltage and frequency than the RF signal, to the first pair of continuous rods during an axial ejection procedure. For example, the auxiliary RF signal can comprise an auxiliary frequency having a predetermined value related to the first frequency of the RF signal.

In various aspects, the mass spectrometer can also comprise a DC voltage source configured to provide a first DC voltage to the long segment of each rod in the second pair of segmented rods and a second higher DC voltage to the shorter segment of each rod in the second pair of segmented rods. In related aspects, the mass spectrometer can further comprise an exit lens located between the linear ion trap and the ion detector. A third DC voltage that is higher than the second higher DC voltage can be applied to the exit lens during a trapping procedure and a fourth DC voltage that is lower than the second higher DC voltage can be applied to the exit lens during an axial ejection procedure. In some related aspects, the mass spectrometer can also comprise a set of electrodes located at the ion source end of the linear ion trap that are configured to be energized by a fifth DC voltage that is higher than the first DC voltage.

In various aspects of the present teachings, a method for operating a mass spectrometer to facilitate mass selective axial ejection of ions is provided. The method can comprise steps of providing a linear ion trap comprising two axially aligned, interleaved pairs of parallel conductive rods that define an axial direction having an upstream end and an exit end, the pairs including a first pair of continuous rods and a second pair of segmented rods, each segmented rod having a long segment and a shorter segment that is located proximate to the exit end, wherein each long segment of each rod is electrically coupled to the shorter segment via a capacitor, such that an RF voltage applied to the long segments will result in a lower RF voltage being applied to the shorter segments, the lower RF voltage being at least 1% less than the RF voltage applied to the long segments. The method can also include creating a DC well in the axial direction by applying a first DC voltage to the first pair of continuous rods and the long segments of the second pair of segmented rods, applying a second DC voltage, higher than the first DC voltage, to the shorter segments of the second pair of segmented rods, applying a third DC voltage, higher than the second DC voltage, to an exit lens located at the exit end of tire linear ion trap, and applying a fourth DC voltage, higher than the first DC voltage, to electrodes located upstream of the shorter segments of the second pair of segmented rods. Ions can be trapped in the linear ion trap by applying a first RF voltage to the first pair of continuous rods and a second RF voltage of the same frequency and substantially the same voltage to the long segments of the second pair of segmented rods. The method can also include injecting ions from an ion source upstream of the linear ion trap and ejecting ions axially in a mass dependent manner by applying a third auxiliary AC voltage at a lower voltage and frequency than the first RF voltage to the first pair of continuous rods, such that the third auxiliary AC voltage is of opposite phase at each continuous rod.

In some aspects of the exemplary method described herein, each long segment of each segmented rod is electrically coupled to the shorter segment via the capacitor such that the second RF voltage applied to the long segments will result in a third RF voltage applied to the shorter segments having a voltage that is 15%-25% less than the second RF voltage. In various aspects, the first and second RF voltages can be of opposite phase.

In some aspects, the step of ejecting ions can further comprise lowering the third DC voltage at the exit lens such that the third DC voltage is lower than the second DC voltage at the shorter segments of the second pair of segmented rods. Additionally or alternatively, the step of ejecting ions further comprises ramping the first and second RF and third auxiliary RF voltage over time.

DETAILED DESCRIPTION OF ILLUSTRATIVE EMBODIMENTS

A quadrupole linear ion trap is proposed to facilitate mass-selective axial ejection (MSAE) to eject ions in the axial direction that utilizes one set of segmented electrodes. Whereas the electrodes utilized in the quadrupole systems discussed above are solid/continuous and rely on fringing fields for axial ejection, embodiments of the present teachings utilizes capacitively coupled exit segments on a pair of electrodes to produce a reduced RF field in the quadrupole, outside of the area normally subjected to flinging fields. As explained below, this reduced RF field can induce an axial force on trapped ions to induce axial ejection outside of the end region normally subjected to fringing fields.

Figure 1:
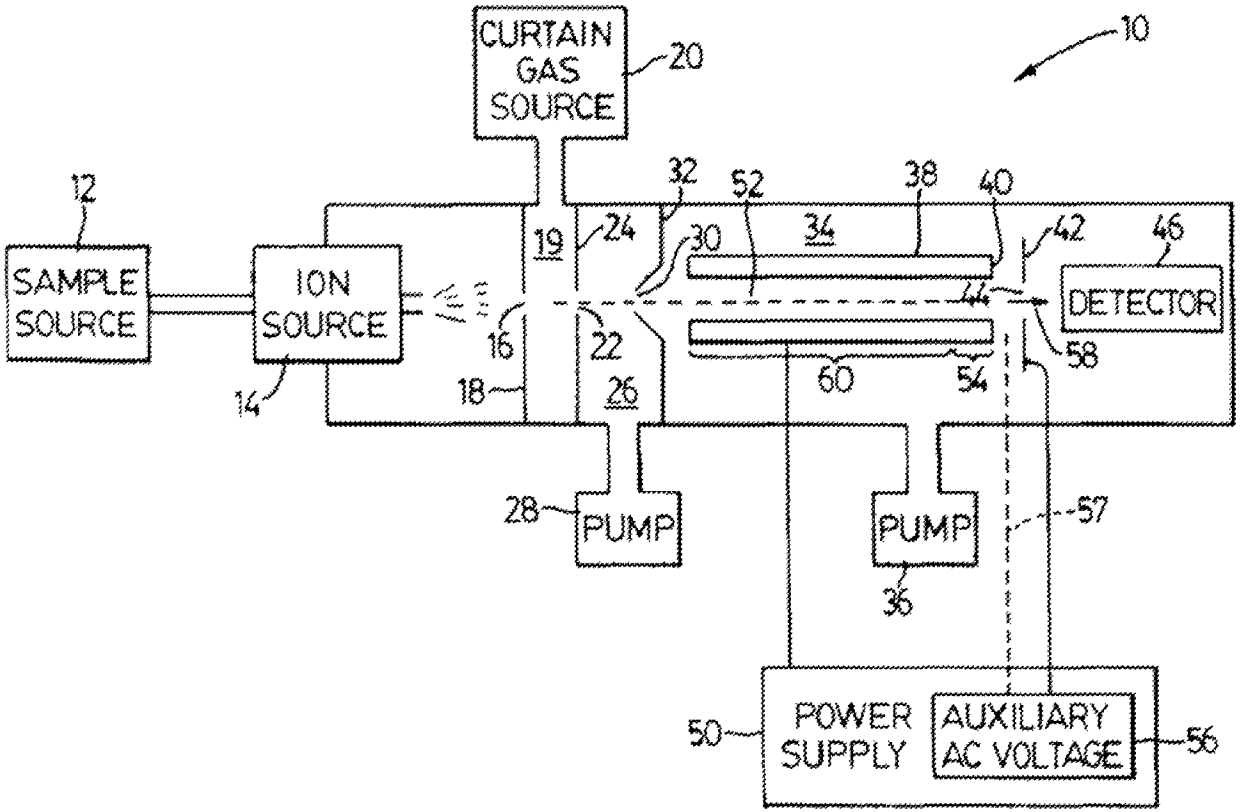
FIG. 1 Prior Art
FIGS. 1 and 1*a* depicts an exemplary mass spectrometer system.

An exemplary system that can utilize a linear ion trap in accordance with the embodiments disclosed herein is shown in FIG. 1. Such a system is discussed in further detail in concurrently assigned U.S. Pat. No. 6,177,668, which is incorporated herein by reference. Whereas the ion traps disclosed therein utilize quadrupoles comprising a set of continuous conductive electrode rods, the electrode rods used in the present embodiments utilize an electrode set comprising a pair of continuous rods and a pair of capacitively-coupled segmented conductive electrode rods, allowing the introduction of an RF drop at the end segments of the rods. In some embodiments, the capacitive coupling on the pair of segmented rods can be used to introduce a DC component to facilitate ion trapping and/or ejection. It should be appreciated that the segmented ion traps disclosed herein can be readily substituted for the ion traps disclosed in U.S. Pat. No. 6,177,668 to create a mass spectrometer utilizing embodiments of the present invention.

FIG. 1 shows a mass analyzer system 10 with which embodiments of the invention may be used. The system 10 includes a sample source 12 (normally a liquid sample source such as a liquid chromatograph) from a which sample can be supplied to a conventional ion source 14. Ion source 14 may be an electrospray, an ion spray, or a corona discharge device, or any other known ion source.

Ions from ion source 14 are directed through an aperture 16 formed in an aperture plate 18. Plate 18 forms one wall of a gas curtain chamber 19 which is supplied with curtain gas from a curtain gas source 20. The curtain gas can be argon, nitrogen or other inert gas. The ions then pass through an orifice 22 in an orifice plate 24 into a first stage vacuum chamber 26, which can be evacuated by a pump 28 to an exemplary pressure of about 1 Torr.

The ions then pass through a skimmer orifice 30 in a skimmer plate 32 and into a main vacuum chamber 34 evacuated to an exemplary pressure of about 2 milli-Torr by a pump 36.

The main vacuum chamber 34 contains a set of four linear conventional quadrupole rods 38. In an exemplary embodiment, the rods 38 may typically have a rod radius r=0.470 cm, an inter-rod dimension r0=0.415 cm, and an axial length l=20 cm. The quadrupole rods 38 can be segmented and operate in accordance with the quadrupole trap embodiments disclosed throughout.

Located about 2 mm past the exit ends 40 of the rods 38 is an exit lens 42. The lens 42 is a plate with an aperture 44 therein, allowing passage of ions through aperture 44 to a conventional detector 46 (which may for example be a channel electron multiplier of the kind conventionally used in mass spectrometers).

The rods 38 are connected to the main power supply 50 which applies a DC rod offset to all the rods 38 and also applies RF between the rods in any manner disclosed herein. The power supply 50 can also be connected (by connections not shown) to the ion source 14, the aperture and orifice plates 18 and 24, the skimmer plate 32, and to the exit lens 42.

In one exemplary situation for detecting positive ions, the ion source 14 may typically be at +5,000 volts, the aperture plate 18 may be at +1,000 volts, the orifice plate 24 may be at +250 volts, and the skimmer plate 32 may be at ground (zero volts). The DC offset applied to rods 38 may be −5 volts. The axis of the device, which is the path of ion travel, is indicated at 52.

Thus, ions of interest which are admitted into the device from ion source 14 move down a potential well and are allowed to enter the rods 38. Ions that are stable in the main RF field applied to the rods 38 travel the length of the device undergoing numerous momentum dissipating collisions with the background gas. However a trapping DC voltage, typically −2 volts DC, is applied to the exit lens 42. Normally the ion transmission efficiency between the skimmer 32 and the exit lens 42 is very high and may approach 100%. Ions that enter the main vacuum chamber 34 and travel to the exit lens 42 are thermalized due to the numerous collisions with the background gas and have little net velocity in the direction of axis 52. The ions also experience forces from the main RF field which confines them radially. In some embodiments, the RF voltage applied is in the order of about 450 volts (unless it is scanned with mass) and is of a frequency of the order of about 816 kHz. In some embodiments, no resolving DC field is applied to rods 38.

When a DC trapping field is created at the exit lens 42 by applying a DC offset voltage, which is higher than that applied to the rods 38, the ions that are stable in the RF field applied to the rods 38 are effectively trapped.

In a conventional solid/continuous electrode ion trap, ions in region 54 in the vicinity of the exit lens 42 will experience fields that are not entirely quadrupolar, due to the nature of the termination of the main RF and DC fields near the exit lens. Such fields, commonly referred to as fringing fields, will tend to couple the radial and axial degrees of freedom of the trapped ions. This means that there will be axial and radial component of ion motion that are not mutually orthogonal. This is in contrast to the situation at the center of rod structure 38 further removed from the exit lens and fringing fields, where the axial and radial components of ion motion are not coupled or are minimally coupled. In embodiments using the segmented rods disclosed herein, ions experience an axially varying field ahead of any fringing fields, due to the reduced RF field across the segment gap. It has been shown that fringing fields penetrate with substantial effect to about 2ro, where ro is the distance between each rod and the center axis of the quadrupole.

With respect to fringing areas of a quadrupole, because the fringing fields couple the radial and axial degrees of freedom of the trapped ions, ions may be scanned mass dependently axially out of the ion trap constituted by rods 38, by the application to the exit lens 42 of a low voltage auxiliary AC field of appropriate frequency. (An example of the frequencies that may be used is given later in this description.) The auxiliary AC field may be provided by an auxiliary AC supply 56, which for illustrative purposes is shown as forming part of the main power supply 50. The auxiliary AC field is in addition to the trapping DC voltage supplied to exit lens 42 and couples to both the radial and axial secular ion motions. The auxiliary AC field is found to excite the ions sufficiently that they surmount the axial DC potential barrier at the exit lens 42, so that they can leave axially in the direction of arrow 58. The deviations in the field in the vicinity of the exit lens 42 lead to the above described coupling of axial and radial ion motions enabling the axial ejection at radial secular frequencies. This is in contrast to the situation existing in a conventional ion trap, where excitation of radial secular motion will generally lead to radial ejection and excitation of axial secular motion will generally lead to axial ejection, unlike the situation described above. The segmented rods discussed herein can achieve a similar effect to overcome DC potential by using the RF drop across the capacitively coupled segment gap.

In some ion traps, ion ejection in a sequential mass dependent manner can be accomplished by scanning the frequency of the low voltage auxiliary AC field. When the frequency of the auxiliary AC field matches a radial secular frequency of an ion in the vicinity of the exit lens 42, the ion will absorb energy and will now be capable of traversing the potential barrier present on the exit lens due to the radial/axial motion coupling. When the ion exits axially, it will be detected by detector 46. After the ion is ejected, other ions upstream of the region 54 in the vicinity of the exit lens are energetically permitted to enter the region 54 and be excited by subsequent AC frequency scans. As explained below, a similar mass scanning effect can be achieved by ramping the RF voltage while keeping the scanning frequency the same. Furthermore, in some embodiments the auxiliary AC voltage can be applied to a subset of the rods or segments, while applying a DC potential to the exit lens.

In a conventional mass selective instability scan mode for rods 38, the RF voltage on continuous rods would be ramped and ions would be ejected from low to high masses along the entire length of the rods when the q value for each ion reaches a value of 0.907.

In some embodiments, instead of scanning the auxiliary AC voltage applied to exit lens 42, the auxiliary AC voltage on exit lens 42 can be fixed and the main RF voltage applied to rods 38 can be scanned in amplitude, as will be described. While this does change the trapping conditions, a q of only about 0.2 to 0.3 is needed for axial ejection, while a q of about 0.907 is needed for radial ejection, allowing ions to be ejected axially more easily. The relationship between q, mass (or mass to charge m/z) and RF frequency and amplitude is explained below.

Figure 1A:
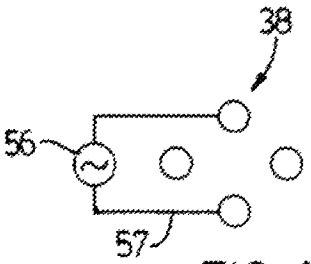

As a further alternative, and instead of scanning either the RF voltage applied to rods 38 or the auxiliary AC voltage applied to exit lens 42, a further supplementary or auxiliary AC dipole voltage or quadrupole voltage may be applied to rods 38 (as indicated by dotted connection 57 in FIG. 1) and scanned, to produce varying fringing fields which will eject ions axially in the manner described. As is well known, when an auxiliary dipole voltage is used, it is usually applied between an opposed pair of the rods 38, as indicated in FIG. 1*a*.

Alternatively, a combination of some or all of the above three approaches (namely scanning an auxiliary AC field applied to the exit lens 42, scanning the RF voltage applied to the rod set 38 while applying a fixed auxiliary AC voltage to exit lens 42, and applying an auxiliary AC voltage to the rod set 38 in addition to that on lens 42 and the RF on rods 38) can be used to eject ions ax tally and mass dependency past the DC potential barrier present at the exit lens 42.

The ion trap illustrated in FIG. 1 can be used in conjunction with additional upstream quadrupoles to form multistage analyzer, as discussed in U.S. Pat. No. 6,177,668.

Figure 2:
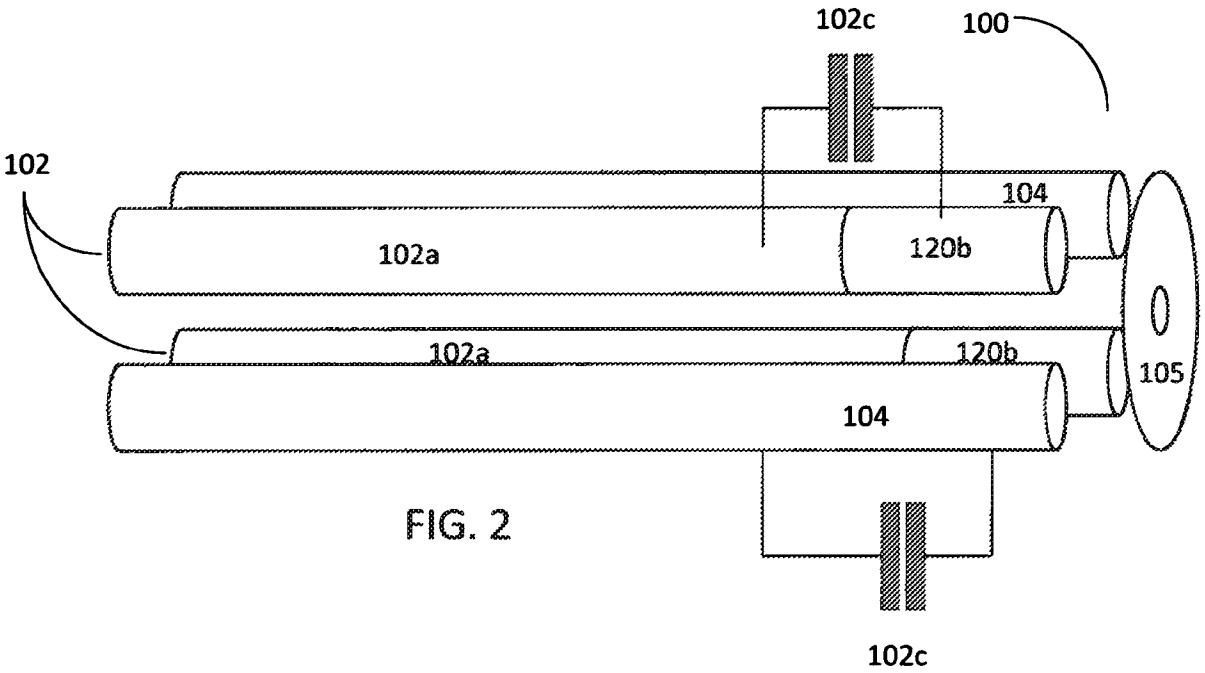
FIG. 2 depicts an exemplary quadrupole in accordance with various aspects.

Whereas FIG. 1 has been discussed generally with respect to an arbitrary quadrupole ion trap or an ion trap having four continuous rods, embodiments of an ion trap for use with this invention generally use a quadrupole having a single pair of continuous rods and a single pair of segmented rods having short segments of the rods on the exit end of the quadrupole. An exemplary quadrupole for use with this invention is shown in FIG. 2. Quadrupole 100 comprises two pairs of parallel conductive rods, where each pair of rods is spaced diagonally, such that no pair of rods is adjacent to itself in the arrangement. This arrangement can be described as interleaved pairs. These rods are substantially completely aligned in the axial direction such that the extent of each pair of rods is substantially coextensive in the axial direction (e.g. overlapping at least 90%, parallel within at least 2 degrees, and having at least 95% the same overall length within the ion trap). Each rod in the pair of segmented rods 102 includes a first long conductive segment 102*a* and a second stubby conductive segment 102*b*. Stubby segment 102*b* is positioned at the exit end of the quadrupole. Segments 102*a* and 102*b* are capacitively coupled to one another. A discrete capacitor 102*c* couples each pair of segments 102*a* and 102*b*. The value of capacitor 102*c* is chosen such that when an RF voltage is applied to long segment 102*a* at a frequency within a known range, the RF voltage that reaches segment 102*b* via capacitor 102*c* is substantially diminished by a predetermined amount relative to the main RF voltage applied to segment 102*a*. Specifically, the RF voltage applied at segment 102*b* can be reduced by at least 1%. In some embodiments, the preferred RF drop between segments 102*a* and 102*b* is between 15% and 25%. RF voltages are applied to both the long segments 102*a* of rods 102 and to rods 104, as explained below. As will be explained below, this RF drop achieved via the capacitive coupling between the two segments results in an asymmetric RF field in the axial direction that facilitates axial ejection of ions in the trap. Quadrupole 100 terminates at a conductive aperture referred to as an exit lens 105.

Figure 3:
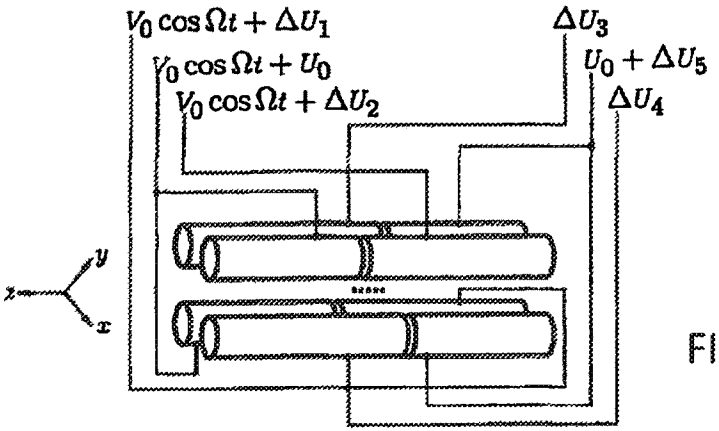
FIG. 3 (prior art)
FIG. 3 depicts a conventional quadrupole.

Quadrupole 100 can be distinguished from other quadrupoles used in the prior art that utilize segmented rods, for various reasons. For example, Wineland ("Ionic Crystals in a Linear Paul Trap" Rhys. Rev. A, Vol. 45, No. 9, 6493-6501, May 1992) teaches a linear Paul trap that utilizes two pairs of segmented rods, arranged radially symmetrically, where the segments of adjacent pairs are offset in the axial direction relative to the other pair. Wineland treats each pair of segmented rods differently. One diagonal pair, which has segments aligned in the axial direction, receives the same RF voltage with a different DC potential on each of the two segments for each rod. Meanwhile, the other diagonal pair of segmented rods receives no RF voltage, instead receiving two different DC potentials at each segment. The second pair of segmented rods has segments that are aligned within the pair, but the segmentation gap is offset relative to the segmentation gap of the first diagonal pair, creating three regions of axial space that can be independently manipulated using DC voltages. This allows an RF field to be produced within the Paul trap, while allowing easy manipulation of DC a vial fields to affect axial containment. For example, the end segments defined by the shorter segments of the rods can be DC manipulated to create DC barriers to contain ions axially in the center section, where the long segments overlap. The quadrupole of Wineland is reproduced as FIG. 3, where Ω represents an RF frequency, and ΔU represents a DC voltage.

Figure 4:
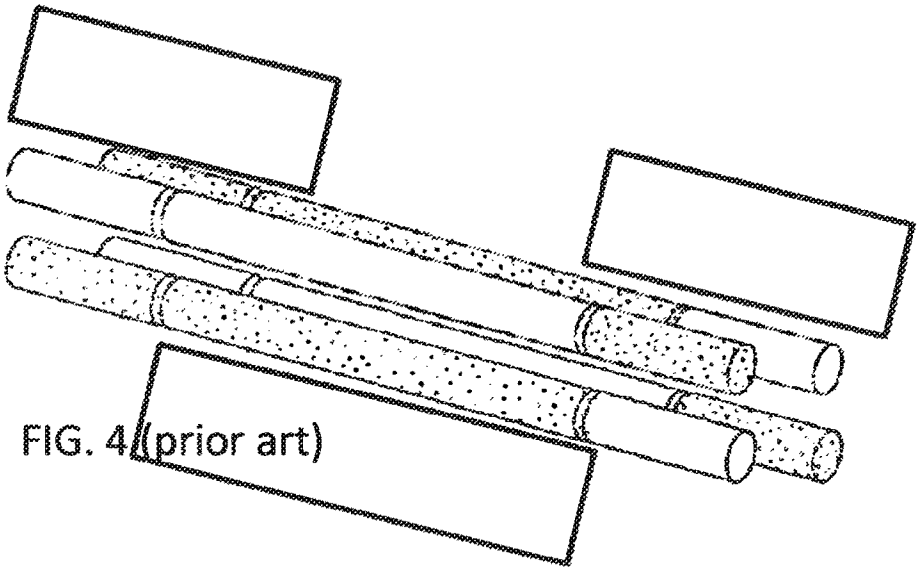
FIG. 4 (prior art)
FIG. 4 depicts a conventional quadrupole.

U.S. patent application No. 2011/49358 to Green also teaches a quadrupole having segmented rods. Like Wineland, Green also teaches that each rod in the quadrupole is segmented. Rather than providing an axial offset between segments in pairs of rods, each rod contains three segments: first short segment, a long middle segment, and a short and segment. Like Wineland, the three regions defined by the segments, allow different DC potentials to be applied to the segments to produce a DC well in the axial direction to act as an ion trap. Unlike Wineland, all 4 rods in the quadrupole receive an RF signal. In each rod, the first two segments receive an RF signal in phase, while the end segment receives the RF signal out of phase. While the entry segment and center segments can be capacitively coupled to receive the same phased RF signal, in some embodiments in Green, the RF signal is swapped between adjacent pairs of rods and respective end segments, creating an RF barrier due to the phase change. Thus, an RF phase change is introduced at the exit end of the quadrupole, creating an RF barrier. Accordingly, the end segments of each rod are not capacitively coupled with the center segments of each rod, but rather coupled with the center segments of the adjacent rod pair. An exemplary quadrupole of Green is reproduced as FIG. 4, where like shaded rod segments utilize a signal of the same phase.

In contrast, quadrupole 100 in FIG. 2 utilizes one pair of segmented rods, arranged diagonally in the quadrupole, and one pair of continuous on-segmented rods, arranged diagonally, such that the pairs are interleaved. Both sets of rods receive an RF signal. The end segments of the segmented rod pair are capacitively coupled to the RF signal of the long segment of the RF pair, which results in an RF drop, but substantially the same RF phase. Thus, quadrupole 100 does not rely on all 4 rods being segmented, a DC well achieved by utilizing offset rods segments between adjacent rod pairs, or an RF phase change between exit segments and the main segments of a quadrupole rod, as in the prior art. Thus, quadrupole 100 utilizes a physical arrangement and electrical arrangement not disclosed in the prior art known to the applicant. Accordingly, quadrupole 100 operates on a different principle than the previously discussed prior art to create an axial barrier and axial force to eject ions out of the linear ion trap.

Figure 5:
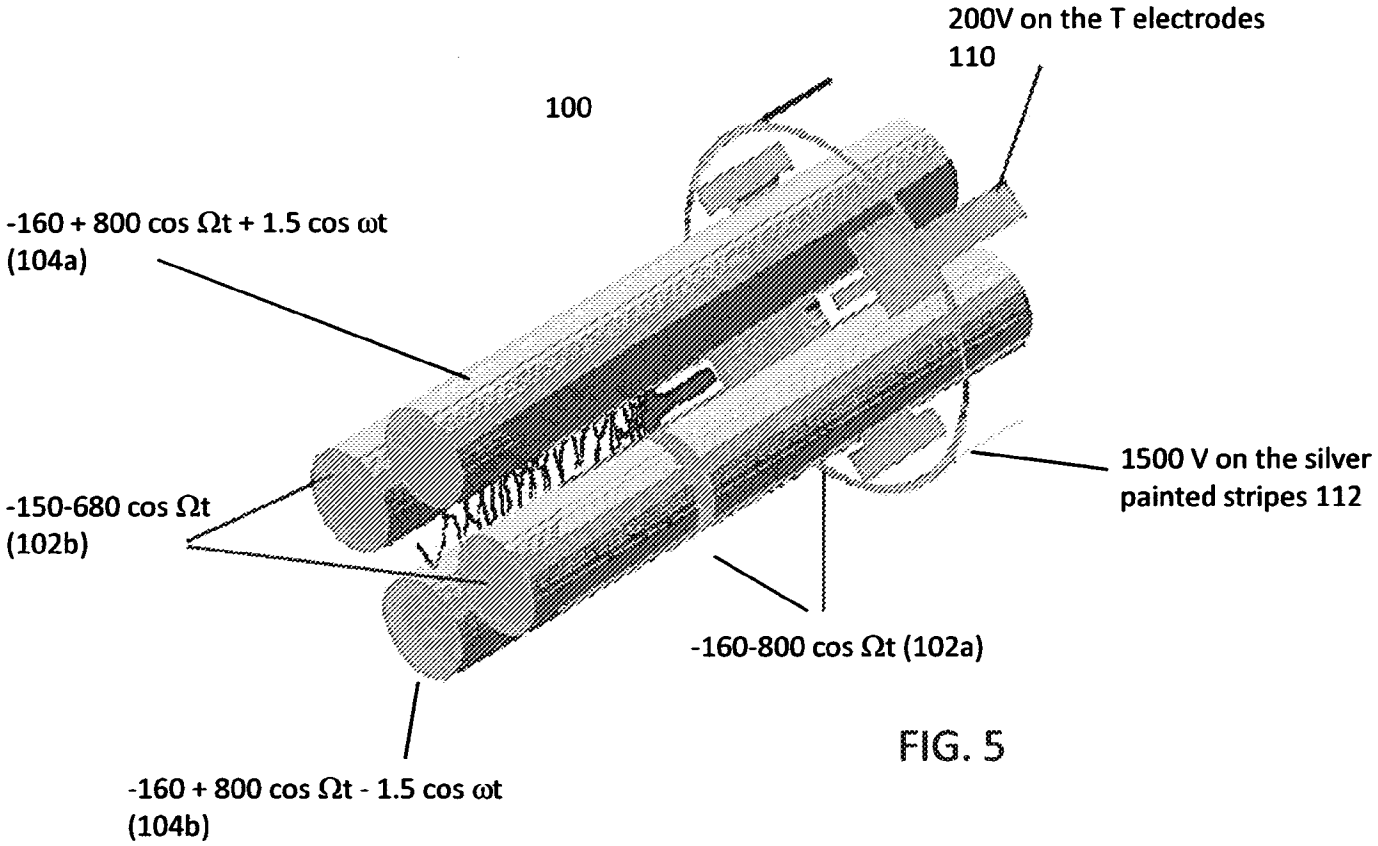
FIG. 5 depicts a quadrupole in accordance with various aspects.

FIG. 5 depicts the voltages applied to rod segments of quadrupole 100 (oriented the opposite way relative to that shown in FIG. 2). These voltages can be applied from power supply 50 of FIG. 1 or via any conventional circuit means capable of supplying RF and DC voltages disclosed herein. Continuous rods 104 receive a DC voltage and a main RF voltage at frequency Ω. During axial election from quadrupole trap 100, a smaller AC signal at a different frequency ω is also applied to rods 104, with a different phase being applied to each of the rods and the pair, 104*a* and 104. Meanwhile, rod segment 102*a* receives a DC voltage consistent with the DC voltage applied to rods 104, and RF voltage at substantially the same magnitude and frequency as, but out of phase with, the main RF voltage applied to rods 104. Because rods segments 102*a* and 102*b* are capacitively coupled using a capacitor 102*c* that facilitates a predetermined RF drop, rods segments 102*b* receive an RF signal in phase with that applied to rods segments 102*a*, but substantially diminished. In this example, the magnitude of the resulting RF signal applied to rod segments 102*b* is 85% of the RF signal applied to rod segments 102*a*, because the capacitive coupling (not shown) results in a 15% RF drop between the segments. Rod segments 102*b* also receive a DC potential that is more positive than that applied to rod segments 102*a* or rods 104. This results in a net DC barrier in the exit direction to help constrain positive ions within the ion trap. These ions, when excited by the auxiliary AC signal applied to rods 104, can overcome this DC barrier in a mass dependent manner. In the entrance direction, T electrodes 110 are placed between she rods and are energized to a positive DC potential (e.g., 200 V). This facilitates the creation of a DC well between the T electrodes 110 and tire exit ends of the rods. In some embodiments, silver stripes 112 painted on a ceramic substrate that holds the rods can be further energized to a more positive DC potential (e.g., 1500V) to further facilitate ion travel from the entrance and to the exit end, where they can be trapped.

Figure 6A:
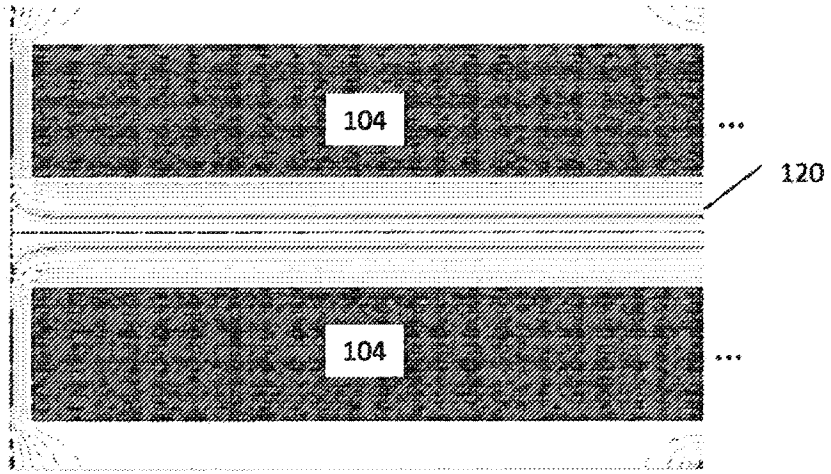
FIGS. 6A and 6B illustrate the electric field between each pair of rods in accordance with various aspects.
Figure 6B:
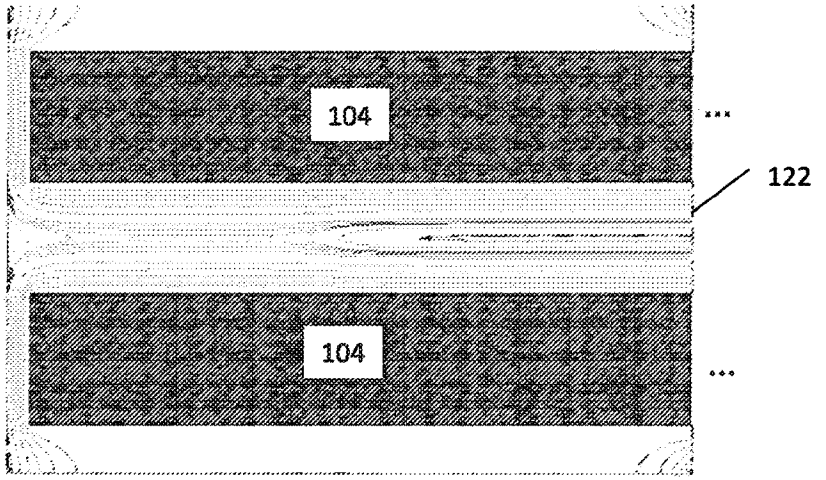

FIGS. 6A and 6B illustrate the electric field exhibited between each pair of rods in two different conditions. FIG. 6A illustrates the equipotential lines when no rods are segmented, as in a conventional ion trap. As shown in FIG. 6A, looking at the rods in the y-z plane, defined as the plane parallel to rod pair 104, the space between rods 104 results in equipotential lines 120 that ran substantially parallel to the rods because the RF signal is applied continuously to the entirety of rods 104. FIG. 6A only shows of the exit end of the rods, where the exit is to the left of the page. FIG. 6B illustrates the effect of adding segments to rods 102, and applying an RF drop across the segment gap. In FIG. 6B, also in the x-z plane, equipotential lines 122 show the effects of the RF drop between long rod segment 102*a* and stubby exit end rod segment 102*b*. Because of the reduced RF signal on segments 102, the electric field gradient between the center point and the rod segments is reduced. This results in electric field gradient that includes an axial component between segments 102*a* and 102*b*.

Simulations have shown that substantially no axial ejection takes place when substantially the same RF voltages are applied to segments 102*a* and 102*b*, which has been the case in the previously discussed prior art configurations. However, when a substantial RF voltage drop occurs between two segments of a rod, MSAE is accomplished, with previously trapped ions being ejected in the direction of the RF drop. For example, simulations and experiments in which an RF drop of 15 to 25% occurred between the long portion of a rod and the stubby end segment of a rod, demonstrate that a portion of trapped ions will be ejected in the axial direction, allowing these ions to be detected at a detector placed at the exit end of the trap. By adjusting the RF voltages applied to the rod segments in the ion trap, as discussed below, ions can be selectively ejected from the trap due to the axial ejection resulting from the RF drop. RF voltages can be adjusted to scan for masses (or m/z ratio) of ions, allowing the linear ion trap to be useful for mass spectrometry purposes. It should be appreciated, that the resulting ejected ions exhibit a detectable polarization due to the diminished RF potential and resulting reduced secular motion in the plane of the segmented rods 102 and the increased secular motion in the plane of rods 104, caused by the auxiliary RF signal that excites ions for ejection at frequency ω.

In MSAE the fundamental frequency of the ion motion is increased by ramping up the trapping field RF amplitude and ions start gaining radial amplitude due to oil-resonance excitation with the high amplitude dipole excitation field of fixed frequency. In the fringing field, radial energy is converted in axial kinetic energy. The axial kinetic energy increase is a strong function of both the amplitude of the ions' motion in the fringing field and the proximity of the ions to the exit end of the linear ion trap. When the ions' axial kinetic energy is large enough to overcome the exit barrier ions get ejected. In general the extraction efficiency can be defined as the ratio of the total number of ions that get ejected from the trap versus the total number of ions in the trap. In general this extraction efficiency is less than 100% since some of the ions, during the excitation process, can reach large radial kinetic energies that allow them to overcome the radial RF confinement field and hit the rods before being ejected.

In general the higher the barrier, the lower the extraction efficiency since while the rate of increase of the radial and kinetic energies remains the same for different DC barriers, the ions need to gain higher axial energies to overcome the barrier and thus the number of ions that would hit the rods would increase.

Figure 7A:
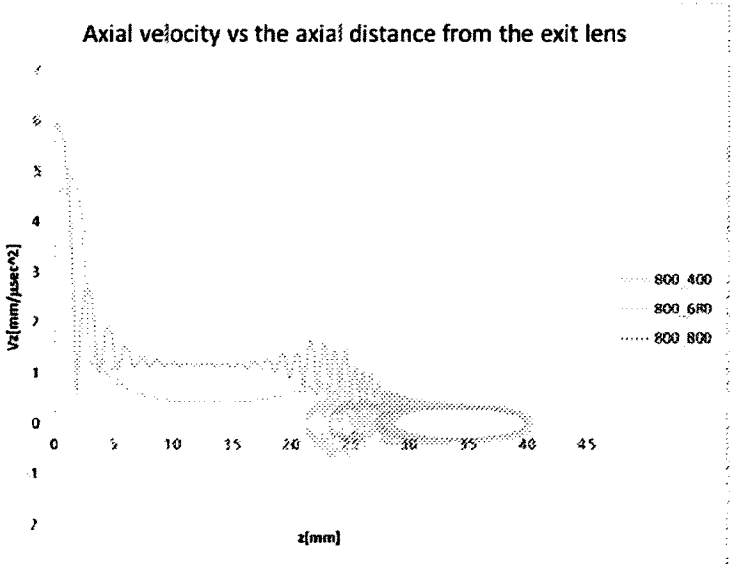
FIGS. 7A and 7B illustrate simulation data in accordance with various aspects.
Figure 7B:
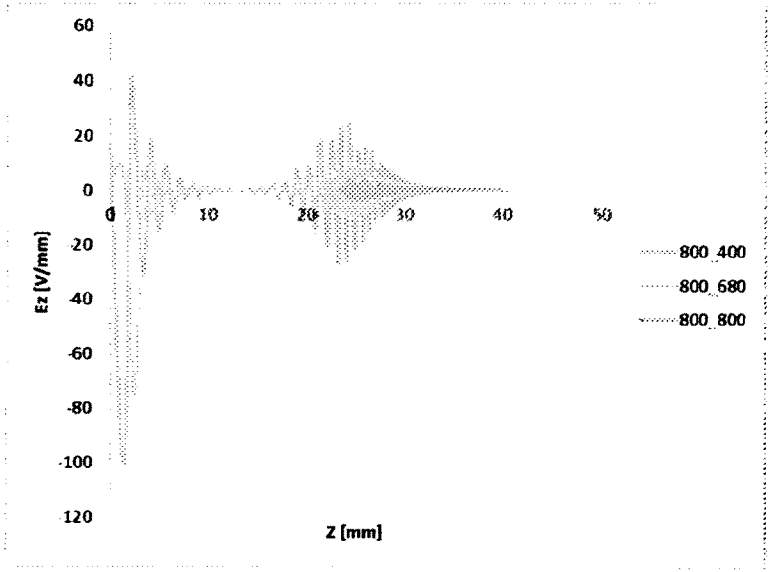

Simulation data show that at 10V barrier on the two short segments, the ions gain enough axial energy to overcome the DC barrier only when RF drops across the gap. At no RF drop across the gap the amplitude of the ion motion in the y direction increases until it exceeds the internal radius of the rod array, i.e. 4 mm and the ions end up being lost on the rods. Despite the feet that the energy gained in the y direction is similar for all cases, the energy that is coupled in the axial direction varies with the amount of RF drop (FIG. 7A), i.e. the higher the RF drop, the higher the energy accumulation rate in the axial direction. The ions travel deeper inside the trap (FIG. 7A), up the electrostatic potential wall created by the voltage applied to short segments and the T electrodes, and each time they come into the vicinity of the fringing fields they gain more axial energy until this energy is high enough to overcome the exit barrier so that the ions get ejected out of the trap. This is due to the fact that both the magnitude and the degree of penetration of the axial fringing field are higher at higher RF drop (FIG. 7B).

Experimental results confirmed the fact that the more energy that is coupled axially (due to the higher RF drop), the higher the voltage barrier that can be applied for the same ion extraction efficiency.

The increase in the RF drop across the gap improves the coupling between the axial and radial motion of the ions in the vicinity of the gap. Ions gain axial energy at a faster rate and are ejected with greater peak resolution and sensitivity especially at fast scan speeds. The improvements observed vary with scan rate. The higher the scan rate the greater the improvements in extraction efficiency that were observed.

In an exemplary experiment, a DC barrier applied to the short segments (102*b*) was ramped during an MSAE scan. For the best resolution the DC applied, during MSAE, on the short T electrodes (110) was 200 V. The trap was tested with a 15% and 25% RF voltage drop across the segmented electrodes, using capacitor values of 18 pf and 8.2 pF. The bigger the drop used the bigger the EXB barrier required to achieve a certain resolution. The trap defined by the distance from laser cuts that form a gap between segments 102*b* and 102*a* to the edge of the short T electrodes was 2.5 cm long.

Experimentally, the trap showed an increase in resolution relative to the regular QTrap 4500 available from AB Sciex, 7.1 Four Valley Drive Concord, Ontario, L4K 4V8, Canada. Thus at 940 kHz the full-width half-height (FWHH) was 0.2 Da at 10 kDa/s and 0.3 Da at 20 kDa/s. During the experiment, a grass-shaped signal was observed at high mass that is likely be due to the charging of the exposed ceramic situated between the segments.

Figure 8A:
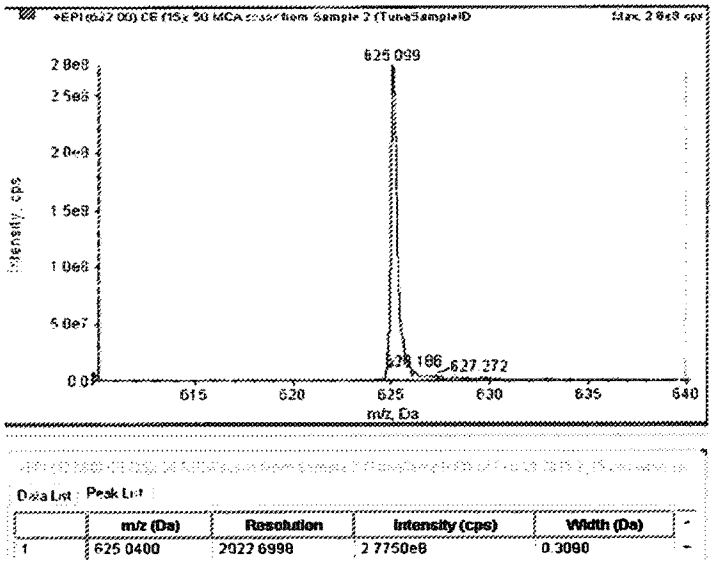
FIGS. 8A and 8B illustrate experimental data in accordance with various aspects.
Figure 8B:
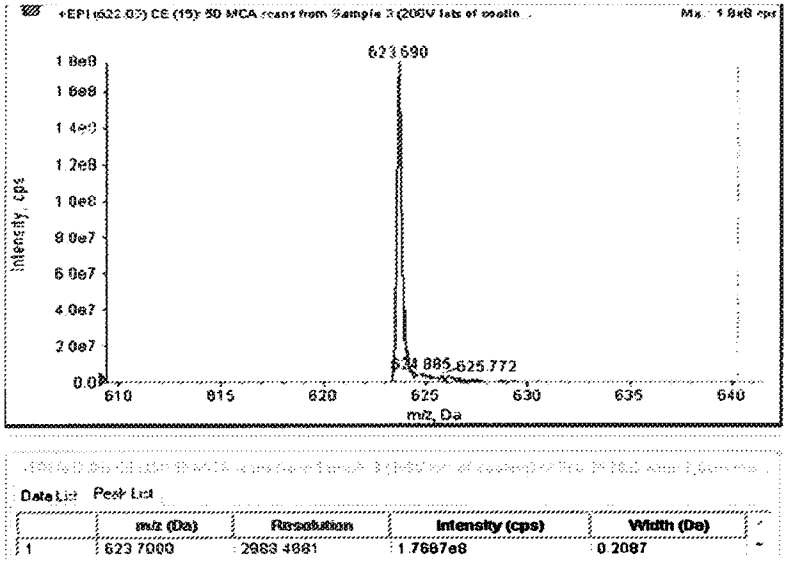

The data from that experiment, using a 25% RF drop between segments 102*a* and 102*b*, is shown in FIGS. 8*a* and 8*b*. In that experiment, the regular exit lens was held at 15V attractive, relative to the rods, during ejection. FIG. 8A shows the mass spectrum observed by an ion detector at the exit lens aperture for a sample having a mass to ohmic ratio of 622 Da at an injection rate of 20 kDa/s. The observed peak was at 625 Da with a resolution of 2022.69 and a peak observed intensity of 2.775e8 cps and a FWHH of 309 Da. FIG. 8B shows the mass spectrum observed by an ion detector at the exit lens aperture for a sample having a mass to charge ratio of 622 Da at an injection rate of 10 kDa/s. The observed peak was at 623 Da with a resolution of 2998.46 and a peak observed intensity of 1.767e8 cps and a FWHH of 0.2087 Da.

Quadrupole 100 can be operated as an ion trap using MSAE as follows. Ions enter quadrupole 100 from an ion source, as explained with respect to FIG. 1. Because the axial velocities can be substantial until the ions cool, DC voltages can be utilized to create a DC well and barrier within trap 100. Collisions with gas from the collision cell can cool the ions in fraction of a second, allowing the ion trap to fill, cool, and prepare the ions for mass scanning. With respect to FIG. 5, ions enter from the right, passing T electrodes 110 and painted stripes 112. T electrodes and stripes can receive a large positive DC voltage, which pushes positive ions into the trap portion of rods 102 and 104. In this example, stripes 112 receive a 1500 V positive DC potential, while T electrodes received 200V of positive DC potential. Exit lens 105, not shown in FIG. 5, which would be on the left side, receives a grounded DC potential. By applying a negative DC potential to the rods in the trap, the resulting DC field in the axial direction creates a potential well between the T electrodes and the exit lens. In this example, rods 104 receive a DC potential of −160V, while the long portion 102*a* of rods 102 receives the same −160V DC potential. Stubby segments 102*b*, located near the exit lens, receive a slightly higher potential of −150 V. This helps top the cooling ions in the area of rods 102*a*, creating a barrier at the segmentation gap between rods 102*a* and 102*b*. Meanwhile, an RF voltage of 800V at a frequency Ω is applied to rods 104 and rod segments 102*a*. A discrete capacitor 102*c* electrically couples each segment 102*a* and 102*b*. By choosing a capacitor value that results in a predetermined RF drop between the signal applied to segment 102*a* and the responding signal generated by capacitor 102*c* to segment 102B, an exemplary RF voltage of 680V can be applied to segment 102*b*, which is necessarily at the same frequency. The RF signal applied to rods 104 and the RF signal applied to rods 102 is out of phase by 180°, which results in a radially confining field and introduces oscillatory and secular motion to the trapped ions.

Once the ions have been trapped and allowed to cool, for example for 30 ms, an auxiliary AC signal can be applied to continuous rods 104. In this example, the auxiliary AC voltage is applied at 1.5V, which is substantially less than the main RF voltage of 800V. The auxiliary RF voltage is applied at a different frequency ω than the mam RF signal at frequency Ω. The auxiliary RF voltage, while small, can be used to mass selectively excite ions trapped in the axial well. During this ejection phase, a negative DC voltage such as −175 V, can be applied to the exit lens, which provides an axial gradient to eject ions that overcome the DC well of stubby segments 102*b*, facilitating ejection.

In some embodiments, the frequency of the auxiliary RF voltage applied to continuous rods 104 can be varied to mass dependency resonate certain ions. However, in other embodiments, the auxiliary frequency ω and the main RF frequency Ω can be chosen to have a predetermined fixed relationship that defines the stability of ions in the trap. Specifically, in some embodiments, ion ejection can be carried out at a frequency of excitation of 2π×383 kHz corresponding to excitation at a Mathieu stability parameter of q 0.846 as the drive (trapping field) frequency, Ω, is 2π×940 kHz.

The relationship between ω and Ω to maintain a Mathieu stability parameter can be understood in further detail in Hager, J. W., A New Linear Ion Trap Mass Spectrometer; Rapid Commun. Mass Spectrom. 2002; 16; 512-526. The q for a given mass is also affected fay the magnitude of the RF voltage and the frequency, q can be calculated using the following equation, which reveals that instability can be introduced by changing the RF voltage or frequency.

$$q = \frac{4eV_{RF}}{m\Omega^2 r_o^2}$$

Thus, mass-dependent instability can be introduced by ramping up the RF voltage of the main RF signal and the auxiliary RF signal. This instability can readily result in axial ejection to overcome the DC barrier provided by the DC potential applied to the stubby rod segments 102*b*. Accordingly, an MSAB scan can be accomplished by ramping up the RF voltage applied to rods 104 and rod segments 102*a* (and capacitively segments 102*b*).

The steps for trapping and performing an MSAB scan of ions can be reiterated as follows.

During a trapping procedure, ions are injected and trapped in the linear ion trap. A DC well is created by applying huge positive voltage to T electrodes (e.g. 200V) and/or stripes (e.g. 1500 V) on the injection/upstream side of the linear ion trap, a substantial negative voltage (e.g. −160 V) is applied to rods 104 and rod segments 102*a* to create a negative DC well, a slightly less negative DC voltage (e.g. −150 V) is applied to stubby segments 102*b*, and a more positive DC voltage to an exit lens (e.g. −70 V) to ensure positive ions are attracted toward the negative DC well created by the main rod segments. In one embodiment; the RF frequency Ω is 940 kHz.

Ions are injected into the trap towards the exit lens end of the rods, such that they pass the T electrodes and become trapped in the DC well between the stubby segments and the T electrodes in the axial direction. This is accomplished while applying a large RF voltage to rods 104 and rod segments 102*a* (e.g. 800V RF, as shown in FIG. 5), which capacitively applies a smaller RF voltage to rod segments 102*b*. This traps the ions in a stable manner having oscillatory and secular motion substantially near the center X-Y plane of the linear ion trap, and confined in the z/axial direction.

The ions are allowed to cool by interaction with the collision gas for about 30 ms.

During an ejection procedure, ions are axially ejected in a mass-dependent manner. A dipolar auxiliary AC voltage is applied to the set of continuous rods 104. This increases the axial kinetic energy of the excited ions, and helps them overcome the DC well barrier. In one embodiment this auxiliary RF signal is 1.5V at ω of 383 kHz.

To assist the ions subjected to the auxiliary RF field to eject axially once they overcome the DC field of stubby segments 102*b*, the exit lens can be made more attractive, for example at −175 VDC during this injection phase.

To scan for ion species of a given m/z, the RF voltages of Ω and to can be ramped over time. The ions detected when the RF field is at a given voltage correspond to a predetermined m/z.

Figure 9A:
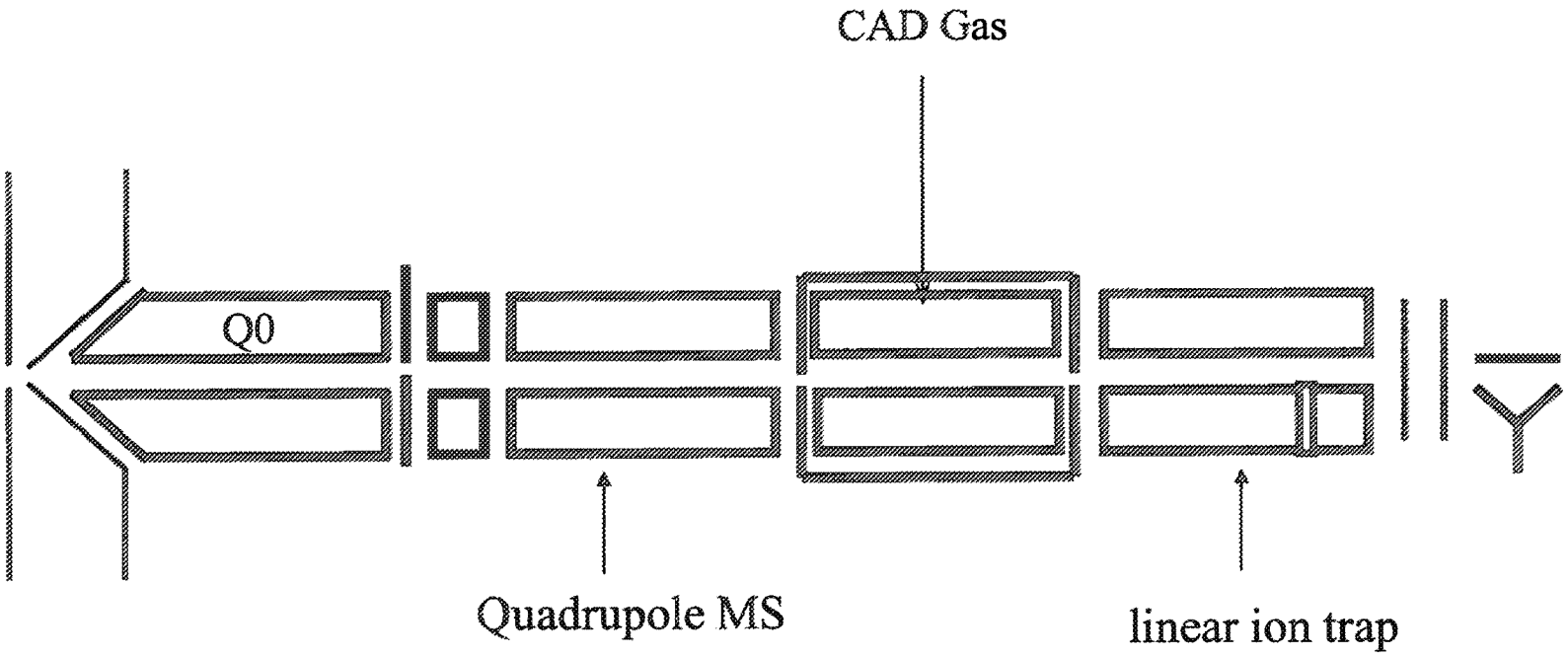
FIGS. 9A, 9B, and 9C illustrate exemplary arrangements of the components of a mass spectrometer in accordance with various aspects.
Figure 9B:
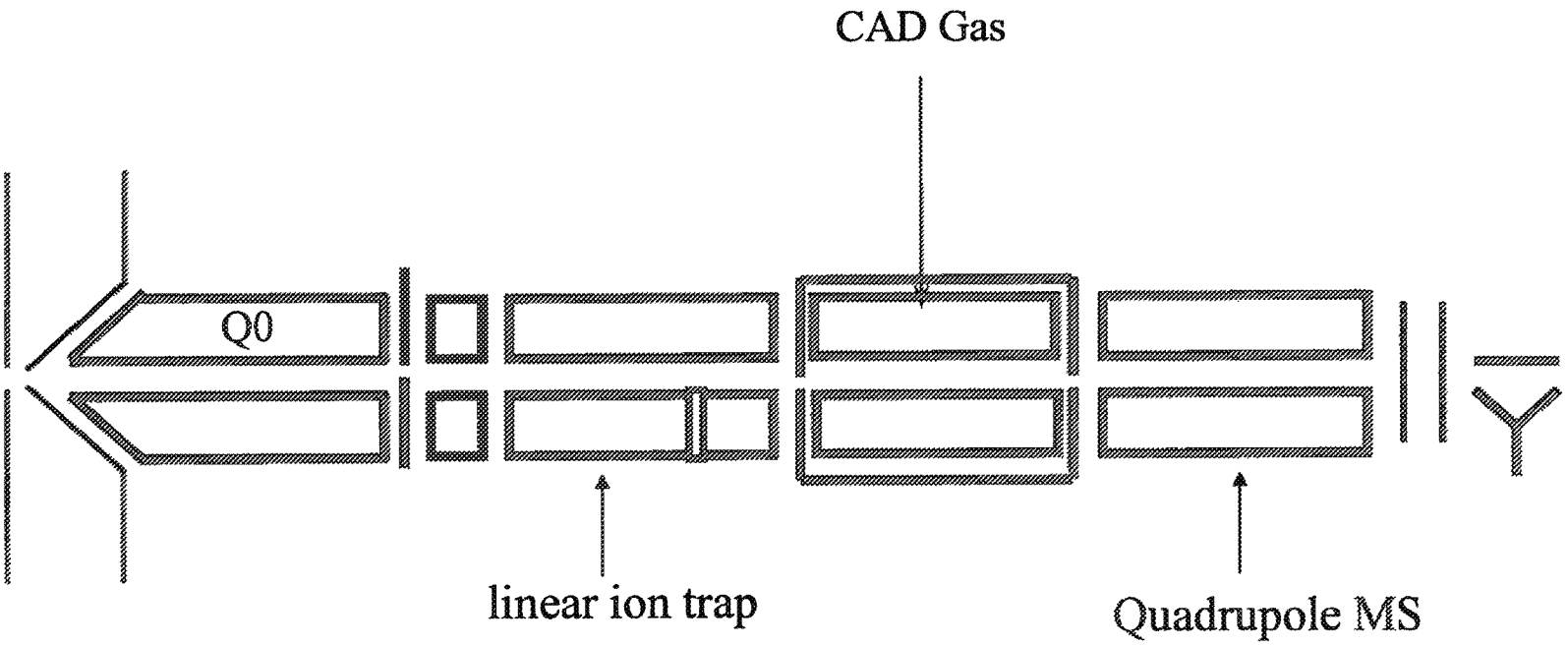
Figure 9C:
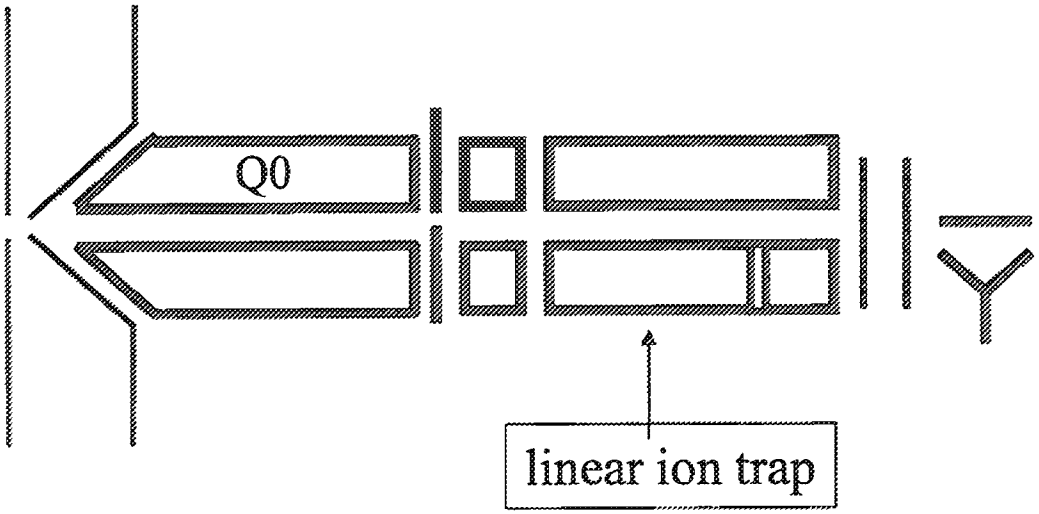

It should be appreciated that embodiments of the segmented quadrupole described throughout can be used in various portions of a linear mass spectrometer. FIGS. 9A-9C illustrate exemplary arrangements of the various components of a mass spectrometer that incorporates a linear ion trap in accordance with embodiments discussed. In FIG. 9A, after a skimmer plate, a conventional quadrupole Q0 focuses ions, which pass through an aperture and stubby quadrupole rods, which act as a Brubaker lens. Another quadrupole MS provides mass resolution to select ions of a certain mass consistent with a precursor ion. A collision cell allows ions to thermally interact with a carrier gas. Ions are then trapped in the linear ion trap, such as ion trap 100, where they can be mass-dependently scanned and observed at a detector via the exit lens.

FIG. 9B is similar to 9A, but the linear ion trap is placed before the collision cell and the quadrupole MS can be used to mass-selectively scan ions for detection. FIG. 9C shows a system that foregoes the collision cell and the quadrupole MS, using a single linear ion trap to perform mass-dependent scans.

What is claimed is:

1. A linear ion trap configured for mass selective axial ejection comprising:

a pair of parallel continuous conductive rods;

a pair of parallel segmented conductive rods each having a long segment and a shorter segment disposed at an exit end of the linear ion trap, wherein the two pairs of conductive rods are axially aligned to be substantially parallel with one another and substantially coextensive in the axial direction, wherein in said two pairs of rods are interleaved with one another such that each conductive rod in a pair is diagonal to the other conductive rod in that pair;

an RF signal generating source configured to supply an RF signal having a first voltage and a first frequency to each rod in the pair of parallel continuous conductive rods and to the long segment of each rod in the pair of parallel segmented conductive rods; and a pair of capacitors that electrically couples the RF signal from the long segments to the shorter segments of the segmented conductive rods, such that a voltage of the RF signal applied to the shorter segment is reduced by at least 1% relative to the first voltage of the RF signal.

2. The linear ion trap of claim 1, wherein the RF signal applied to the rods comprises a first signal having a first phase provided to the pair of parallel continuous conductive rods and a second signal having a second opposite phase provided to the long segment of each rod in the pair of parallel segmented conductive rods.

3. The linear ion trap of claim 1, wherein the RF signal generating source is configured to apply an auxiliary AC signal, at a lower voltage and frequency than the RF signal, to the pair of parallel continuous conductive rods during an axial ejection procedure.

4. The linear ion trap of claim 3, wherein the auxiliary RF signal comprises an auxiliary frequency having a predetermined value related to the first frequency of the RF signal.

5. The linear ion trap of claim 1, further comprising a DC voltage source configured to provide a first DC voltage to the long segment of each rod in the pair of parallel segmented conductive rods and a second higher DC voltage to the shorter segment of each rod in the pair of parallel segmented conductive rods.

6. The linear ion trap of claim 1, wherein the linear ion trap is configured to operate in a mass spectrometer.

7. The linear ion trap of claim 1, wherein the second voltage at the shorter segments is reduced by 15-25% relative to the first voltage of the RF signal.

8. A mass spectrometer using mass selective axial ejection, comprising:

an ion source configured to supply ions in an axial direction and located at one end of the axis;

an ion detector located at the other end of the axis;

a linear ion trap comprising two overlapping parallel pairs of conductive rods of substantially the same length located between the ion source and the ion detector along the axis of the ion trap, the two overlapping parallel pairs comprising a first pair of continuous rods and a second pair of segmented rods, the segmented rods each having a long segment and a shorter segment that is located closer to the ion detector end of the ion trap axis relative to the long segment, wherein each rod in the two pairs is located diagonally from the other rod in that pair, such that each rod in a pair is adjacent to the rods of the other pair;

an RF signal generating source configured to supply an RF signal, having a first voltage and a first frequency, to each rod in first pair of continuous rods and to the long segments of the segmented rods of the second pair; and a pair of capacitors that electrically couples the RF signal from the long segments to the shorter segments of each of the segmented rods of the second pair at a second voltage reduced by at least 1% relative to the first voltage of the RF signal.

9. The mass spectrometer of claim 8, wherein the RF signal applied to the rods comprises a first signal having a first phase coupled to the first pair of continuous rods and a second signal having a second opposite phase coupled to the second pair of segmented rods.

10. The mass spectrometer of claim 8, wherein the RF signal generating source is configured to provide an auxiliary AC signal, at a lower voltage and frequency than the RF signal, to the first pair of continuous rods during an axial ejection procedure.

11. The mass spectrometer of claim 10, wherein the auxiliary RF signal comprises an auxiliary frequency having a predetermined value related to the first frequency of the RF signal.

12. The mass spectrometer of claim 8, further comprising a DC voltage source configured to provide a first DC voltage to the long segment of each rod in the second pair of segmented rods and a second higher DC voltage to the shorter segment of each rod in the second pair of segmented rods.

13. The mass spectrometer of claim 12, further comprising an exit lens, located between the linear ion trap and the ion detector, and a third DC voltage that is higher than the second higher DC voltage is applied to the exit lens during a trapping procedure and to further receive a fourth DC voltage that is lower than the second higher DC voltage during an axial ejection procedure.

14. The mass spectrometer of claim 13, further comprising a set of electrodes located at the ion source end of the linear ion trap that are configured to be energized by a fifth DC voltage that is higher than the first DC voltage.

15. The mass spectrometer of claim 8, wherein the second voltage at the second shorter segments is reduced by 15-25% relative to the first voltage of the RF signal.

16. A method for operating a mass spectrometer to facilitate mass selective axial ejection of ions comprising steps of:

providing a linear ion trap comprising two axially aligned, interleaved pairs of parallel conductive rods that define an axial direction having an upstream end and an exit end, the pairs including a first pair of continuous rods and a second pair of segmented rods, each segmented rod having a long segment and a shorter segment that is located proximate to the exit end, wherein each long segment of each rod is electrically coupled to the shorter segment via a capacitor, such that an RF voltage applied to the long segments will result in a lower RF voltage applied to the shorter segments, where the lower RF voltage is at least 1% less than the RF voltage applied to the long segments;

creating a DC well in the axial direction by applying a first DC voltage to the first pair of continuous rods and the long segments of the second pair of segmented rods, applying a second DC voltage, higher than the first DC voltage, to the shorter segments of the second pair of segmented rods, applying a third DC voltage, higher than the second DC voltage, to an exit lens located at the exit end of the linear ion trap, and applying a fourth DC voltage, higher than the first DC voltage, to electrodes located upstream of the shorter segments of the second pair of segmented rods;

trapping ions in the linear ion trap by applying a first RF voltage to the first pair of continuous rods and a second RF voltage of the same frequency and substantially the same voltage to the long segments of the second pair of segmented rods and injecting ions from an ion source upstream of the linear ion trap; and ejecting ions axially in a mass dependent manner by applying a third auxiliary AC voltage at a lower voltage and frequency than the first RF voltage to the first pair of continuous rods, such that the third auxiliary AC voltage is of opposite phase at each continuous rod.

17. The method of claim 16, wherein each long segment of each segmented rod is electrically coupled to the shorter segment via the capacitor such that the second RF voltage applied to the long segments will result in a third RF voltage applied to the shorter segments having a voltage that is 15%-25% less than the second RF voltage.

18. The method of claim 16, wherein first and second RF voltages are of opposite phase.

19. The method of claim 16, wherein step of ejecting ions further comprises lowering the third DC voltage at the exit lens such that the third DC voltage is lower than the second DC voltage at the shorter segments of the second pair of segmented rods.

20. The method of claim 16, wherein step of ejecting ions further comprises ramping the first and second RF and third auxiliary RF voltage over time.

* * * * *